US006276756B1

(12) United States Patent
Cho et al.

(10) Patent No.: US 6,276,756 B1
(45) Date of Patent: Aug. 21, 2001

(54) HEIGHT ADJUSTING ASSEMBLY FOR A CHAIR

(75) Inventors: Yong Tae Cho, Inchon-shi; Song Hur, Kunpo-shi, both of (KR)

(73) Assignee: Samhongsa Co. Ltd., Seoul (KR)

( * ) Notice: Subject to any disclaimer, the term of this patent is extended or adjusted under 35 U.S.C. 154(b) by 0 days.

(21) Appl. No.: 09/347,516

(22) Filed: Jul. 2, 1999

(30) Foreign Application Priority Data

Jul. 2, 1998 (KR) ..... P98-26546

(51) Int. Cl.[7] ..... A47C 3/20

(52) U.S. Cl. ..... 297/344.19; 248/161; 248/404; 248/631

(58) Field of Search ..... 297/344.19; 248/161, 248/404, 631, 599

(56) References Cited

U.S. PATENT DOCUMENTS 5,636,899 * 6/1997 Schiff et al. ..... 287/344.19
5,826,935 * 10/1998 DeFreitas ..... 248/631
5,829,733 * 11/1998 Becker ..... 248/631
6,045,187 * 4/2000 Stumpf ..... 297/344.19

* cited by examiner

*Primary Examiner*—Anthony D. Barfield
(74) *Attorney, Agent, or Firm*—Birch, Stewart, Kolasch & Birch, LLP

(57) ABSTRACT

A height adjusting assembly for chairs. The assembly includes a first member having a taper holder positioned near an opening/closing pin and a taper arm engaged with the taper holder so as to push the opening/closing pin. A second member having a case, a lead arm engaged with the case and a button which operates the lead arm. A third member having a wire in which one end is connected to the taper arm and the other end is connected to the lead arm and a covering member in which one end is connected to the taper holder and the other end is connected to the case so that the wire is slidable in the covering member and the opening/closing pin is pushed by an operation of the taper arm which is engaged with the wire when the lead arm is operated by the button. The pushing force of the button can be controlled by the length of the taper arm and the rod arm. The height of a chair is adjusted easily and conveniently as the button is installed in the arm resting member of a chair.

19 Claims, 7 Drawing Sheets

HEIGHT ADJUSTING ASSEMBLY FOR A CHAIR

BACKGROUND OF THE INVENTION

1. Field of Invention

The present invention relates to height adjusting mechanism for a chair which stands between a seat and legs of a chair. Furthermore, the present invention is about adjusting height of a chair simply and easily by operating a button which is attached at the arm of a chair. In the height adjusting mechanism for a chair, cable actuator is installed to adjust the height and the button is included in the cable actuator.

2. Description of the Background Art

In the conventional height adjusting mechanism for a chair, a spindle guide 500 is inserted and fixed inside a cylindrical outer tube 600 and a spindle 50 which moves up and down while contacting the inner side of the spindle guide 500 is installed as shown in FIG. 1 which is a vertical cross sectional view. A Gas chamber 30 is included inside the spindle 50 and a piston 11 which engages in piston movement according to the pressure of gas is inserted inside the gas chamber 30. The gas chamber 30 is divided into a first gas chamber 30*a* and a second gas chamber 30*b* along the boundary of the piston 11. The piston 11 is connected to a piston rod 110 which penetrates the second gas chamber 30*b* and one end of the piston rod 110 is fixed to the cylindrical outer tube 600 with a fixing clip 235. A resilience member 620 is inserted at a lower end of the piston rod 110 in order to absorb shock on the outer tube 600 put by the lower end of the piston rod 110 when the spindle 50 moves up and down due to the movement of the piston and to maintain certain resilience. A ball bearing 52 is sandwiched in between bearing support 42 and 44 inserted at a lower end of the resilience member 620. A movement preventing jaw 35 is formed at a lower end of the piston rod 110 in order to prevent the bearing support 42, 44 and the ball bearing 52 from moving up towards upper part of the piston rod 110. As the resilience member and the ball bearing are inserted in the piston rod, shock put on the spindle 50 is absorbed and rotation frictional force of the spindle 50 is reduced.

An opening/closing pin holder 400 which is made of sealing member is mounted outside the first gas chamber 30*a* and the opening/closing pin 120 which can discharge or block gas of the first gas chamber 30*a* is mounted on an opening/closing pin holder 400. Projected end of the opening/closing pin 120 is formed to contact a push button 33 which is attached at an end of the spindle 50. A gas moving valve 160 is formed at an outer wall of a gas chamber 30 so that the first gas chamber 30*a* and second gas chamber 30*b* can move along by the operation of the opening/closing pin 120. In addition, a plurality of O-rings 608 are inserted outside the piston 11 and the opening/closing pin holder 400 in order to maintain sealing and prevent gas inside cylinder from leaking.

In the conventional height adjusting mechanism for a chair structured as described above, height of a chair is adjusted as gas inside the first gas chamber 30*a* and the second gas chamber 30*b*moves back and forth the two chambers through the gas moving valve 160 as the entrance of the first gas chamber 30*a* which is blocked by the opening/closing pin 120 is opened by pushing the push button 33 which is located at an end of the spindle 50 and as the spindle 50 moves according to the movement of the gas. In order to maintain the height of a chair, simply let the opening/closing pin 120 block the entrance of the first gas chamber.

In the conventional height adjusting mechanism for a chair, an extra operating lever 88 needs to be installed at the lower part of a chair to push the push button 33 as the push button 33 is attached at the lower part of the spindle 50 as shown in FIG. 2. Therefore, in order to adjust the height in a chair manufactured with the conventional method, a person sitting on the chair has to bend over to operate the lever which results in inconvenience in operating the lever and unpleasant outlook due to the projected lever.

SUMMARY OF THE INVENTION

In order to settle the above-mentioned disadvantages of the prior art, the present invention has a height adjusting assembly which includes a gas chamber in which a piston is positioned, a spindle having a piston rod which is engaged with the piston and an opening/closing pin which opens and closes the gas chamber to control movement of the spindle, wherein the piston rod is fixed to one end of an outer case to which a spindle is partially inserted into the spindle guide to move upwardly and downwardly along the spindle guide which comprises:

- a first member having a taper holder positioned near the opening/closing pin and a taper arm engaged with the taper holder so as to push the opening/closing pin;
- a second member having a case, a lead arm engaged with the case and a button which operates the lead arm; and
- a third member having a wire in which one end is fixed to the taper arm and the other end is fixed to the lead arm and a covering member in which one end is fixed to the taper holder and the other end is fixed to the case so that the wire is slidable in the covering member and the opening/closing pin being pushed by the operation of the taper arm is engaged with the wire when the lead arm is operate by the button.

The taper arm of the first member is combined to the taper holder with a fixing pin, a first extension member and a second extension member is formed to be in opposition with a certain degree to a fixing part having the fixing pin in the center, the first extension member is to push the opening/closing pin and an end of the wire is fixed to an end of the second extension member.

The length of the second extension member is longer than that of the first extension member and is equal to and longer than 30 mm.

A wire fixing recess is included at an end of the second extension member, a fixing portion is included in an end of the wire and the fixing portion is to be inserted and fixed at the wire fixing recess.

The taper arm is bent with a certain degree outwards the taper holder from the central part of the second extension member.

DETAILED DESCRIPTION OF THE PREFERRED EMBODIMENT

Figure 1:
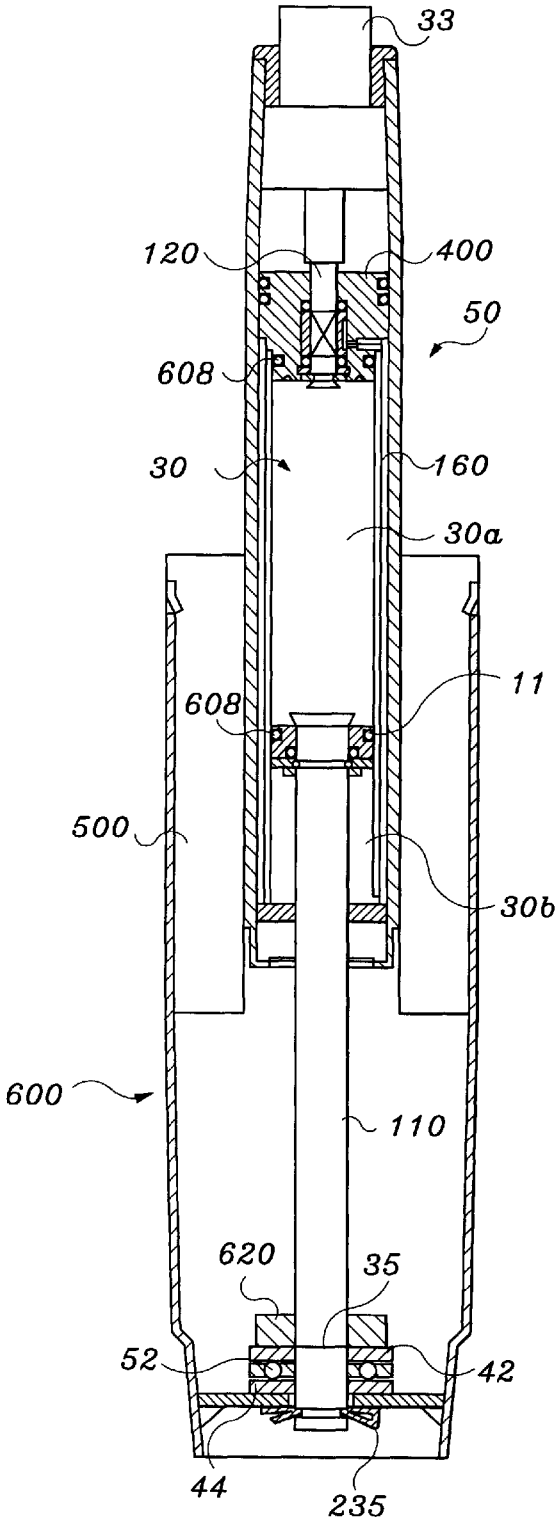
Fig. 1 Prior Art
FIG. 1 is a vertical cross sectional view of conventional height adjusting mechanism for a chair.
Figure 2:
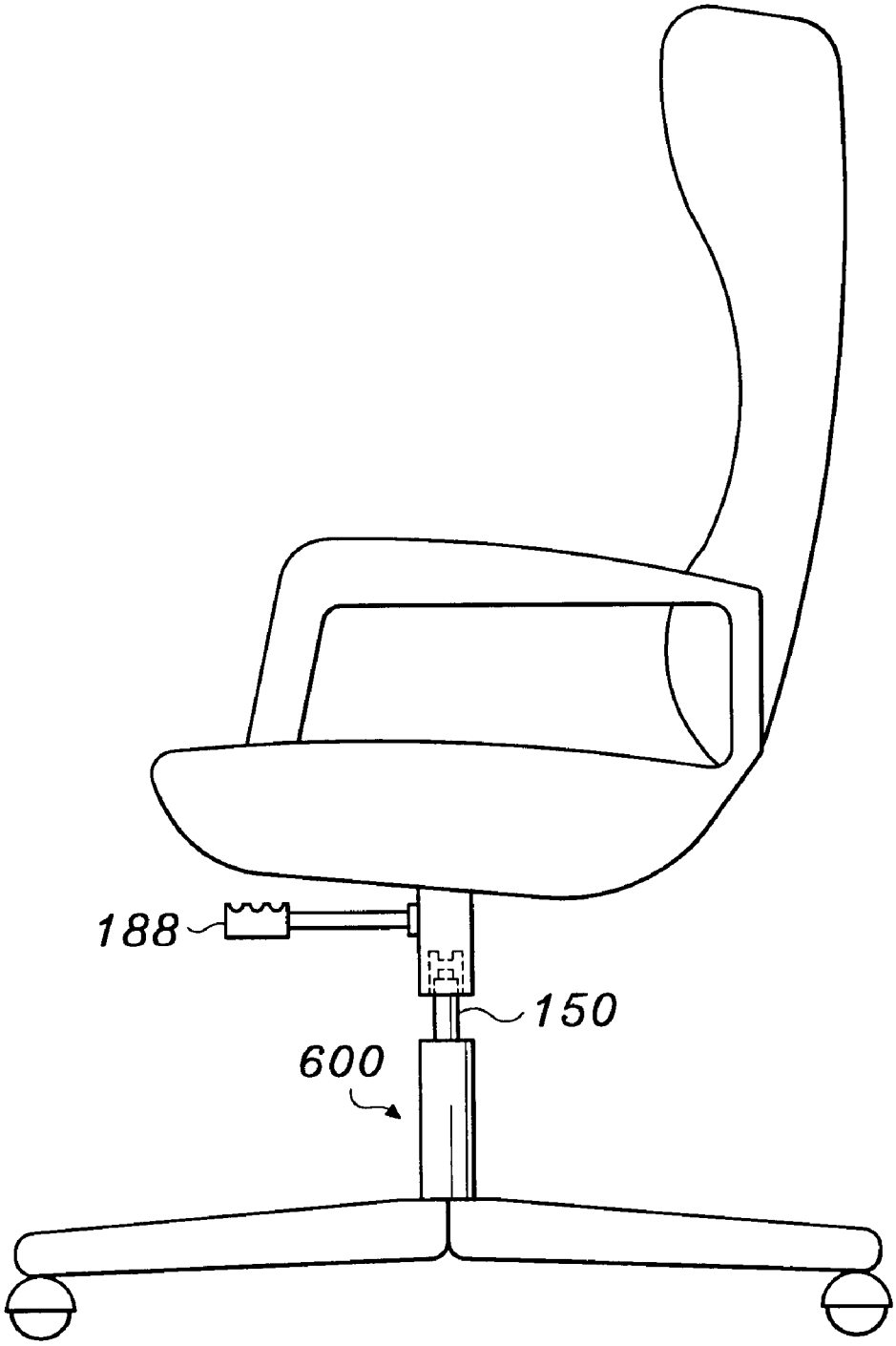
Fig. 2 Prior Art
FIG. 2 is a three dimensional view of the conventional chair.

Present invention of height adjusting mechanism for a chair includes a gas chamber 30 which has a piston 11, an opening/closing pin 120 which controls movement of a spindle by opening and closing the gas chamber and the spindle 50 which includes a piston rod 110 extended from the piston. In the present invention, the piston rod is fixed to an end of the outer tube 600 where a spindle guide 500 is installed, the spindle is partly inserted in the guide of the outer tube and the spindle moves up and down along the spindle guide in the length of the piston rod with the piston in the center. The present invention further comprises a first member which has a taper holder 230 standing around the location of the opening/closing pin 120 and a taper arm 90 which can push the opening/closing pin 120 in addition to combining with the taper holder, a second member which has a case 490, a lead arm 450 which combines to the case and a button 133 which operates the lead arm, a wire 150 in which one end is fixed to the taper arm 90 and the other end is fixed to the lead arm 450 and a third member (cable 250) that has a covering member 350 in which one end is fixed to the taper holder 230 and the other end is fixed to the case 490 in addition to covering the wire so that the wire can move freely. In addition, the present invention characterizes in that the taper arm 90 connected to the wire 150 operates to push the opening/closing pin 120 when the lead arm 450 is operated by the button 133.

In particular, the taper arm 90 of the first member is combined to the taper holder by a fixing pin 100, a first extension member 90*a* is in opposition to a second extension member 90*b* with a certain degree having a fixing part of the fixing pin in the center besides, the first extension part 90*a* is able to push the opening/closing pin 120 and an end of the wire 150 is fixed to an end of the second extension member 90*b*. In addition, a housing 205 penetrating the wire 150 is inserted between the taper holder 230 and the covering member 350, a length adjusting device which can adjust the length of the wire is included in the housing and through the length adjusting of the wire, pushing length of the button 133 can be adjusted. The lead arm 450 of the second member is combined to the case 490 with the fixing pin 101, a first arm 405 is at a right angle to a second arm 407 having the fixing part of the fixing pin 101 at the center in addition to fixing an end of the wire to an end of the second arm and an end of the first arm being pushed by the button 133. The structure and operation of the height adjusting mechanism for a chair according to the present invention is given in detail hereinafter referring to the attached drawings.

PREFERRED EMBODIMENT

Figure 3A:
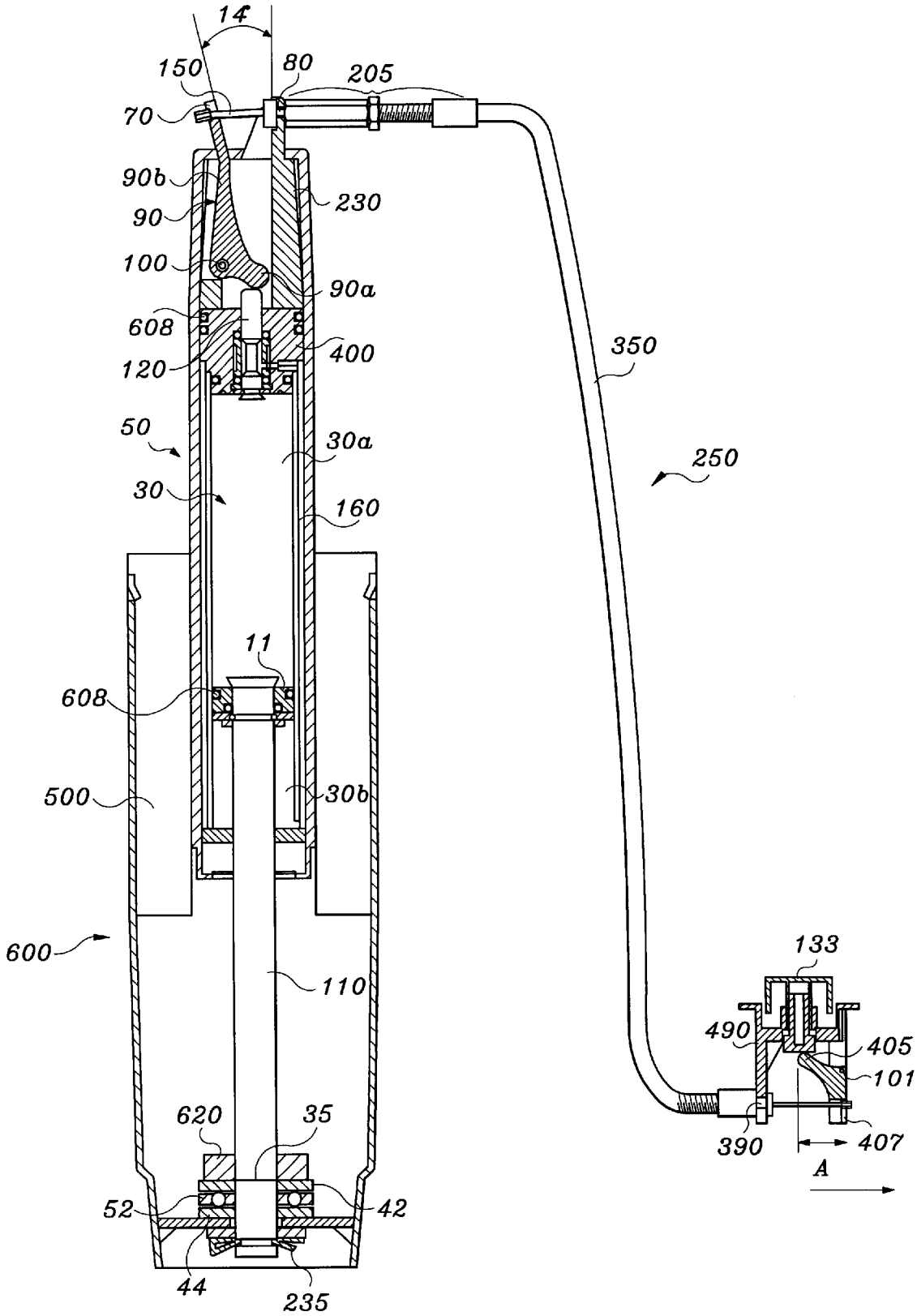
FIGS. 3*a* and 3*b* are vertical cross sectional views of height adjusting mechanism for a chair according to the present invention.
Figure 3B:
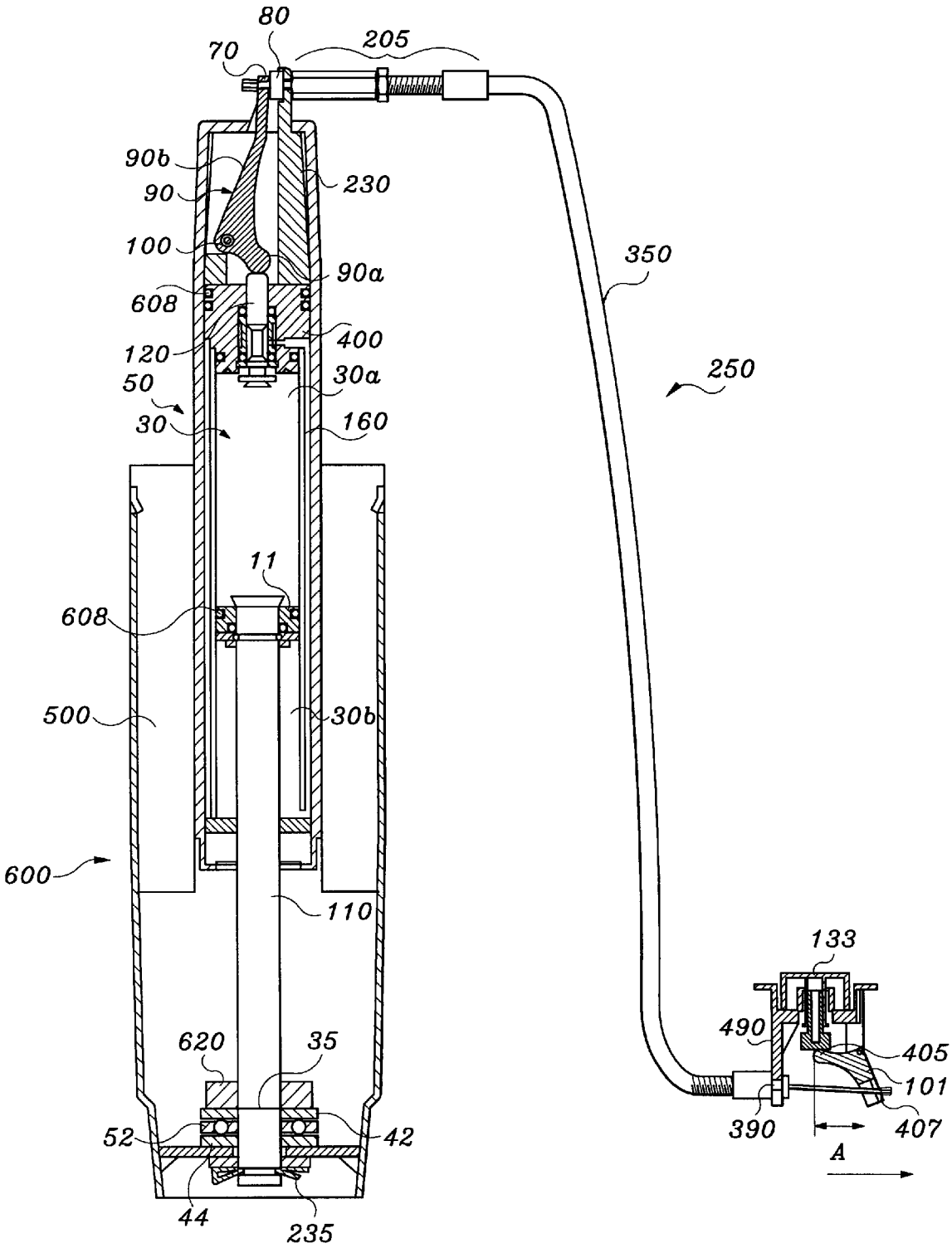

In the height adjusting mechanism for a chair according to the present invention, a spindle guide 500 is installed inside a cylindrical outer tube 600 and a spindle 50 is partly mounted on the spindle guide 500 as shown in FIG. 3A which shows a vertical cross sectional view. A piston 11 in a sealed condition is inserted in a gas chamber 30 which is inside the spindle 50 and a gas chamber 30 that is divided into a first gas chamber 30*a* and a second gas chamber 30*b* along the boundary of the piston 11. The piston 11 which penetrates the second gas chamber 30*b* is connected to a piston rod 110 and an end of the piston rod 110 is fixed to the cylindrical outer tube 600 with a fixing clip 235. A resilience member 620 is inserted at the lower part of the piston rod 110 in order to absorb shock of the spindle 50 and to maintain certain resilience. A ball bearing 52 is inserted between bearing support 42 and 44 at the lower part of the resilience member 620. A movement preventing jaw 35 is formed at the lower part of the piston rod 110 in order to prevent the bearing support 42, 44 and the ball bearing 52 from moving towards the upper part of the piston rod 110. An opening/closing pin holder 400 formed with sealing member is mounted at the entrance of the first gas chamber 30*a* and the opening/closing pin 120 which penetrates the opening/closing pin holder 400 is installed. One end of the opening/closing pin 120 is located at the first gas chamber 30*a* and the other end of the opening/closing pin is projected outwards the opening/closing pin holder 400. A gas moving valve 160 is formed outside the gas chamber 30 so that gas inside the first gas chamber 30*a* and second gas chamber 30*b* can move back and forth the two chambers by operation of the opening/closing pin 120. An O-ring 608 for preventing gas leakage is inserted outside the piston 11 and the opening/closing pin holder 400. A taper holder 230 is mounted on the spindle 50 at the location of the opening/closing pin 120 and taper arm 90 which has a first extension member 90*a* and second extension member 90*b* is fixed to the lower part of the taper with the fixing pin 100. The first extension member 90*a* is installed to push the opening/closing pin 120 and a wire fixing recess 70 is formed at an end of the second extension member 90*b*. The first extension member 90*a* is formed in opposition to the second extension member 90*b* with a certain degree putting the fixing part of the fixing pin 100 at a center. Length of the second extension member is formed to be longer than that of the first extension member and more than 30 mm so that the pressure of the wire 150 pulling the second extension member 90*b* is decreased when the button 133 is pushed. In particular, the taper arm is bent approximately 14 degrees outwards the taper holder from the center of the second extension member so, enough distance between a wire fixing recess 70 and a housing fixing recess 80 is obtained. One end of the wire 150 is fixed to the wire fixing recess 70 of the second extension member and the other end of the wire 150 is fixed to an end of second arm 407 of the lead arm 450. On end of a flexible synthetic resin covering member 350 is fixed to the housing fixing recess 80 which is formed at an end of the taper holder 230 and the other end of the covering member 350 is fixed to a case 490 where the button 133 is inserted. Distance between the housing fixing recess 80 and the wire fixing recess 70 is formed to be greater than the distance of opening/closing pin 120 movement. The wire 150 is covered with the covering member 350 and is formed to move freely inside the covering member. A housing 205 for adjusting an exposed wire fits the housing fixing recess 80 of the taper holder 230 in order to adjust the exposed wire at both ends of the covering member and a moving nut a and bolt b are attached to the housing. The housing is used in adjusting state of tension between the taper arm 90 and load arm 450 by properly adjusting the length of exposed wire as the housing can adjust the length by regulating the bolt and nut. When an end of first arm 405 of the lead arm 450 which is fixed with fixing pin 101 at the case 490 where the button 133 is inserted is pushed by the button 133, an end of second arm 407 of the lead arm 450 moves along the direction of the arrow. Therefore, the first extension member of the taper arm pushes the opening/closing pin 120 as the wire 150 pulls second extension member 90*b* of the taper arm towards the taper holder 230. As distance A from the fixing pin 101 of the lead arm to the central shaft of the button 133 is formed to be greater than 10 mm, the pushing force of the button is decreased to be same or smaller than 3 Kgf. In a cable actuator member comprising the first member including the taper holder 230 which is installed to push the opening/closing pin 120 and the taper arm 90, the second member including the case 490 where the button 133 is installed and the lead arm 450 and the third member (case 250) including the wire 150 which connects the first and second member and the covering member 350, when the force pushing opening/closing pin 120 is assumed to be equal, the force of the button 133 could be decreased by appropriately adjusting the length A of the second extension member 90*b* of the taper arm and the lead arm. When opening/closing pin 120 is opened by pushing the button 133, gas moves to the chamber which has low gas pressure from the chamber which has high gas pressure and accordingly the spindle 50 moves. The body part of the spindle 50 which is mounted on the spindle guide 500 moves along the spindle guide while contacting the surface of the spindle guide as the piston 11 is fixed to the piston rod 110 and the piston rod 110 is fixed to the cylindrical outer tube 600 and in accordance with the movement of the body part of the spindle, the height of the height adjusting mechanism is adjusted. The desired height is maintained when the button 133 returns to its original place after adjusting the height, as the opening/closing pin 120 blocks the entrance of the first gas chamber which leads to the blocking of the gas moving valve 160.

Figure 4:
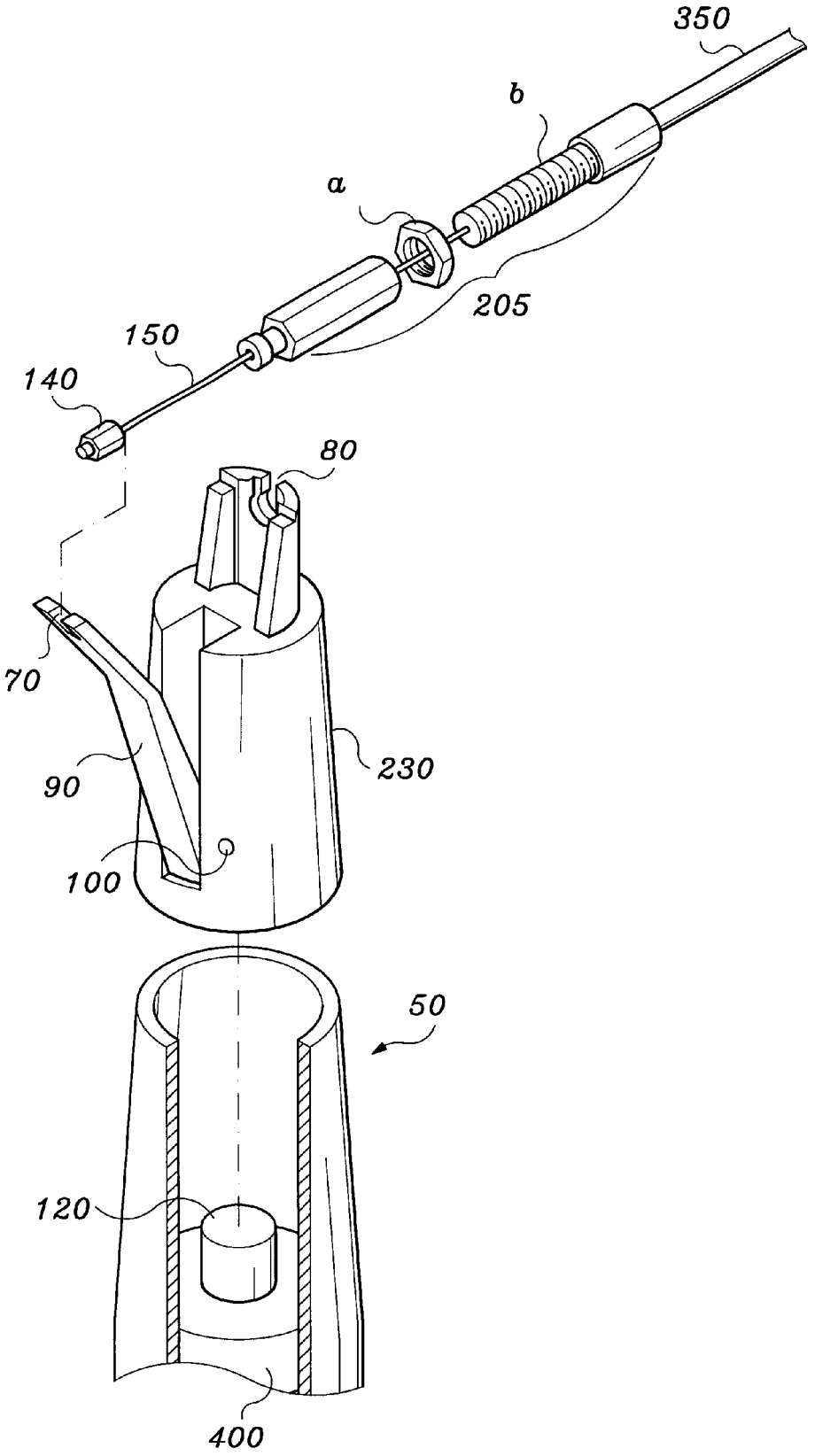
FIG. 4 is a three dimensional view of a disassembled first member according to the present invention.

In a structure of the cable actuator member of the present invention, the taper arm 90 which is fixed with the fixing pin 100 at a lower part of the taper holder 230 is inserted in a rotatable state, the wire fixing recess 70 is formed at the lower part of the taper arm where the wire 150 is fixed and the housing fixing recess 80 is formed on the upper part of the taper holder as shown in FIG. 4. A fixing portion 140 which is fixed at an end of the wire is inserted and fixed at the wire fixing recess 70. On the other hand, means of fixing is formed at the housing 205 which enables the means of fixing to be fixed at the housing fixing recess 80, therefore, the means of fixing is fixed at the housing fixing recess 80. The wire fixing recess 70 is formed at the location of central shaft of the housing 205 in order to reduce the friction between the wire 150 and housing 205. Length of the wire 150 is adjusted by moving nut a and bolt b and the covering member 350 is fixed at an end of the bolt b. The length of wire exposed outside the covering member is adjusted as the housing is formed at an end of the covering member. The taper holder 230 and the taper arm 90 are mounted inside the spindle where the opening/closing pin 120 is located. The first extension member 90*a* of the taper arm which is projected towards the opening/closing pin 120 putting the fixing pin 100 at the center pushes the opening/closing pin 120 when the taper arm 90 is pulled towards the housing fixing recess 80 of the taper holder by the wire 150.

Figure 5:
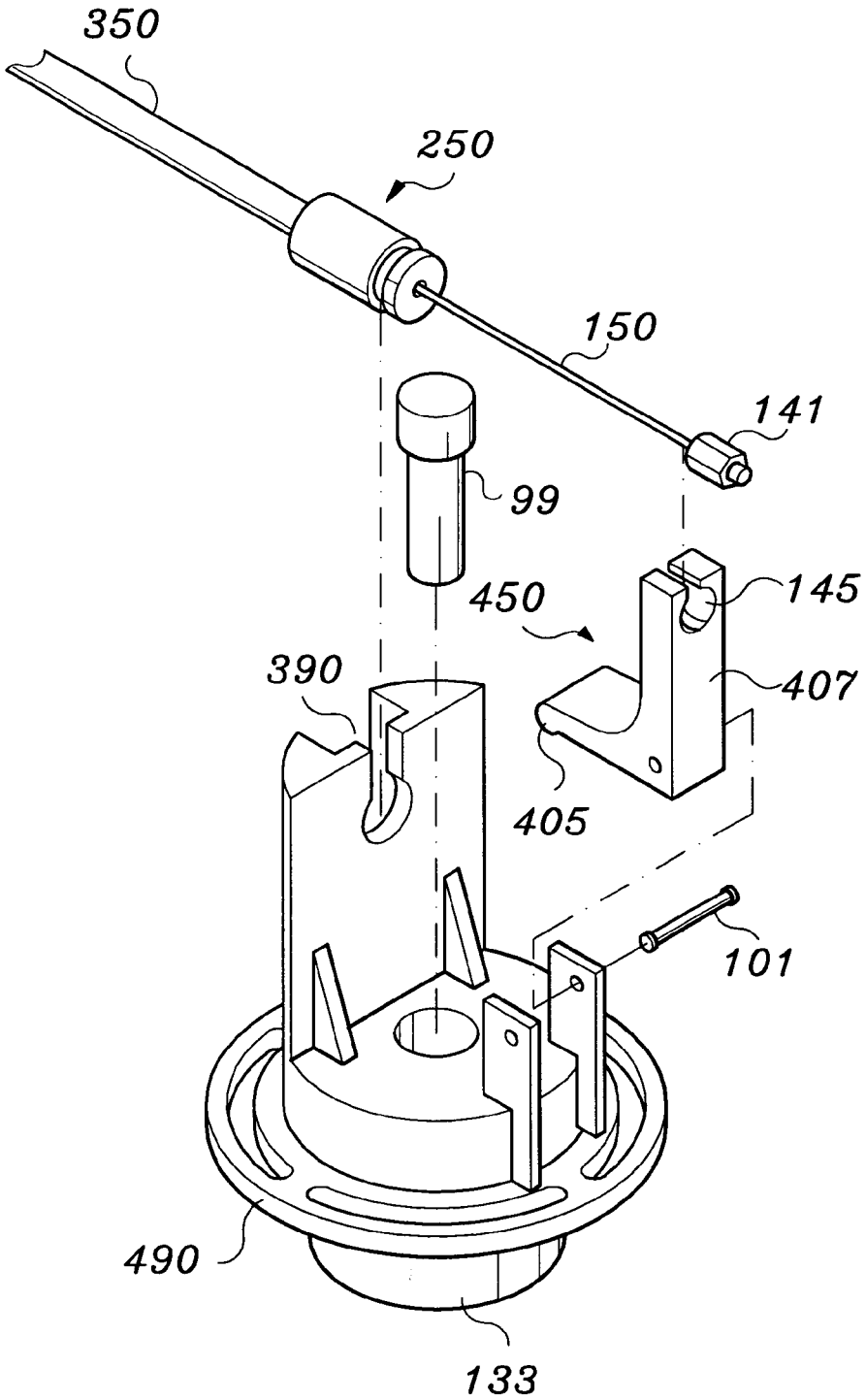
FIG. 5 is a three dimensional view of a disassembled second member according to the present invention.
Figure 6:
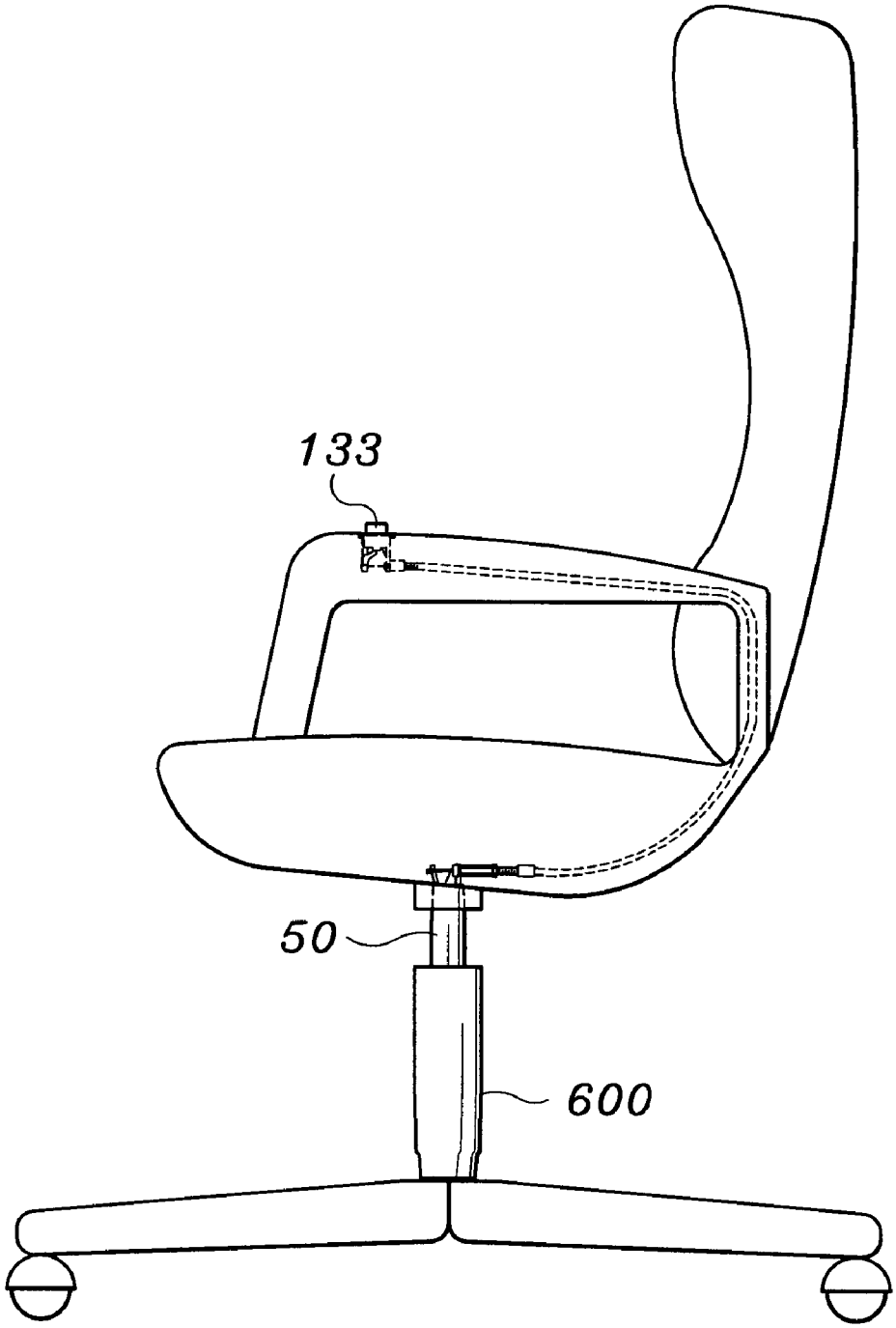
FIG. 6 is a three dimensional view of a chair according to the present invention.

The button 133 which operates to push the opening/closing pin 120 is inserted in the case 490 as shown in FIG. 5 and a fixing recess 390 where an end of the covering member 350 is fixed is formed on the case and the covering member is to be fixed at the fixing recess just by inserting the means of fixing which is formed at an end of the covering member. In addition, a L type lead arm 450 is installed opposite to the fixing recess 390 and the lead arm is fixed in a rotatable state by the fixing pin 101. An end of the first arm 405 of the lead arm which is extended from the pin fixing member of the lead arm contacts pushing pin 99 which is inserted inside the button 133 and an end of the wire 150 is fixed at an end of the second arm 407 of the lead arm. A fixing recess 145 where the fixing portion 141 which is fixed at an end of the wire 150 can be fixed is included in an end of the second arm 407. Projected distance from the fixing pin 101 part of the lead arm 450 to an end of the first arm 405 is one of the important elements in deciding the pushing force of the button 133 in the present invention therefore, pushing force of the button is reduced as the distance gets wider.

The present invention comprises the cable actuator member in which a certain length of cable including the covering member 350 and the wire 150 is positioned between the first member including the taper holder 230, the taper arm 90 and the like and the second member including the button 133, the case 490, the load arm 450 and the like and as the present invention is structured to push the opening/closing pin 120 by the operation of the cable when the button is pushed, the cable is hidden in the arm resting member of a chair and the button 133 is installed accordingly. As a result, there is an effect that a person can easily and conveniently adjust the height of a chair while sitting and as the cable is hidden in the arm resting member, the present invention has better looking than conventional chairs.

What is claimed is:

1. A height adjusting assembly which includes a gas chamber in which a piston is positioned, a spindle having a piston rod which is engaged with the piston and an opening/closing pin which opens and closes the gas chamber to control movement of the spindle, wherein the piston rod is fixed to one end of an outer case to which the spindle is partially inserted into a spindle guide to move upwardly and downwardly along the spindle guide which comprises:

a first member having a taper holder positioned near the opening/closing pin and a taper arm engaged with the taper holder so as to push the opening/closing pin;

a second member having a case, a lead arm engaged with the case and a button which operates the lead arm; and a third member having a wire in which one end is connected to the taper arm and the other end is connected to the lead arm and a covering member in which one end is connected to the taper holder and the other end is connected to the case so that the wire is slidable in the covering member and the opening/closing pin is pushed by an operation of the taper arm which is engaged with the wire when the lead arm is operated by the button.

2. The height adjusting assembly according to claim 1, wherein the taper arm of the first member is engaged to the taper holder with a fixing pin, whereby a first extension member and a second extension member is formed to be in opposition with a certain degree with a fixing part of the fixing pin in a center, such that the first extension member is to push the opening/closing pin and an end of the wire is fixed to an end of the second extension member.

3. The height adjusting assembly according to claim 2, wherein a length of the second extension member is longer than that of the first extension member and is at least equal to or longer than 30 mm.

4. The height adjusting assembly according to claim 2, wherein a wire fixing recess is included at an end of the second extension member, whereby a fixing portion is included at an end of the wire and the fixing portion is to be inserted and fixed at the wire fixing recess.

5. The height adjusting assembly according to claim 2, wherein the taper arm is bent with a certain degree outwards the taper holder from a central part of the second extension member.

6. The height adjusting assembly according to claim 1, wherein a housing in which the wire is penetrated is positioned between the taper holder and the covering member, whereby a length adjusting means which adjusts the length of the wire is included in the housing and pushing length of the button is adjusted by the length adjustment of the wire.

7. The height adjusting assembly according to claim 6, wherein the length adjusting means of the housing further comprises a moving nut and a bolt which are formed within the housing.

8. The height adjusting assembly according to claim 6, wherein a means of fixing is included in an end of the housing, a housing fixing recess is included in an end of the taper holder and the means of fixing of the housing is to be inserted and fixed at the housing fixing recess which is included in an end of the taper holder.

9. The height adjusting assembly according to claim 6, wherein a fixing part of an end of the wire which is included in the taper arm is located in a central shaft of the housing.

10. The height adjusting assembly according to claim 1, wherein the lead arm of the second member is engaged to the case with a fixing pin, whereby a first arm is at a right angle to a second arm such that a fixing part of the fixing pin is at a center, and an end of the wire is connected to an end of the second arm and the button is to push an end of the first arm.

11. The height adjusting assembly according to claim 10, wherein the button is pushed with a force equal to or smaller than 3 kgf.

12. The height adjusting assembly according to claim 10, wherein a wire fixing recess is included in an end of the second arm, whereby a fixing portion is included in an end of the wire and the fixing portion is to be inserted and fixed to the wire fixing recess.

13. The height adjusting assembly according to claim 12, wherein a means of fixing is included at an end of the covering member, whereby a fixing recess of the end of the covering member is included in the case and the means of fixing the end of the covering member is to be inserted and fixed to the fixing recess of the end of the covering member.

14. The height adjusting assembly according to claim 1, wherein the covering member is formed from a soft, flexible material.

15. A height adjusting assembly which includes a gas chamber in which a piston is positioned, a spindle having a piston rod which is engaged with the piston and an opening/closing pin which opens and closes the gas chamber to control movement of the spindle, wherein the piston rod is fixed to one end of an outer case to which the spindle is partially inserted into a spindle guide to move upwardly and downwardly along the spindle guide which comprises:

a first member having a taper holder positioned near the opening/closing pin and a taper arm engaged with the taper holder so as to push the opening/closing pin;

a second member having a case, a lead arm engaged with the case and a button which operates the lead arm; and a third member having a wire in which one end is connected to the taper arm and the other end is connected to the lead arm.

16. The height adjusting assembly according to claim 15, wherein a covering member in which one end is connected to the taper holder and the other end is connected to the case so that the wire is slidable in the covering member and the opening/closing pin is pushed by an operation of the taper arm which is engaged with the wire when the lead arm is operated by the button.

17. The height adjusting assembly according to claim 15, wherein the taper arm of the first member is engaged to the taper holder with a fixing pin, whereby a first extension member and a second extension member is formed to be in opposition with a certain degree with a fixing part of the fixing pin in a center, such that the first extension member is to push the opening/closing pin and an end of the wire is fixed to an end of the second extension member.

18. The height adjusting assembly according to claim 15, wherein the lead arm of the second member is engaged to the case with a fixing pin, whereby a first arm is at a right angle to a second arm such that a fixing part of the fixing pin is at a center, and an end of the wire is connected to an end of the second arm and the button is to push an end of the first arm.

19. The height adjusting assembly according to claim 15, wherein the button is positioned at an arm resting member of a chair.

* * * * *